United States Patent [19]

Stull

[11] Patent Number: 4,648,520

[45] Date of Patent: Mar. 10, 1987

[54] CAP AND MEANS FOR RETAINING CAP LINER

[76] Inventor: Gene Stull, 5 Oak St., Chester, N.J. 07930

[21] Appl. No.: 743,489

[22] Filed: Jun. 11, 1985

[51] Int. Cl.[4] ..... B65D 53/04

[52] U.S. Cl. ..... 215/350

[58] Field of Search ..... 215/329, 350

[56] References Cited

U.S. PATENT DOCUMENTS

| | | | |
|---|---|---|---|
| 1,937,492 | 11/1933 | Merolle | 215/329 |
| 2,039,757 | 5/1936 | Von Till | 215/350 X |
| 2,904,837 | 9/1959 | Crabbe | 215/350 X |
| 3,612,325 | 10/1971 | Williams | 215/350 X |
| 4,378,893 | 4/1983 | Wilde et al. | 215/350 X |
| 4,381,840 | 5/1983 | Ostrowsky | 215/350 X |

FOREIGN PATENT DOCUMENTS

| | | | |
|---|---|---|---|
| 2334579 | 7/1977 | France | 215/350 |

*Primary Examiner*—Donald F. Norton
*Attorney, Agent, or Firm*—H. Gibner Lehmann; K. Gibner Lehmann

[57] ABSTRACT

A plastic closure cap and liner retention arrangement therefor which permits installation of the liner into the cap without distortion of the liner, and thereafter effectively holds the latter captive during subsequent handling or use of the cap. The construction comprises a cup-shaped molded plastic cap having a top wall and an annular side wall, and a sealing liner carried in the cap adjacent its top wall. Internal threads in the cap wall enable the cap to be screwed onto the threaded neck of a container in the usual manner. The cap interior has a ledge structure which may be annular, and in which the liner is nested. The ledge is preferably integral with the top and side walls of the cap. With the cap inverted, and following insertion of the liner into the cap, a punch having one or more tapered working edges is applied to the ledge and displaces a portion thereof to form a retention shoulder. The retention shoulder overlies at least part of the periphery of the liner and prevents inadvertent dislodgement thereof prior to installation of the cap onto the container. The advantage of the invention is that the liner need not be deformed during its insertion into the cap, as normally occurs where such liners are required to by-pass one or more molded lugs or nibs, or alternately to by-pass the cap threads. Also, there is less likelihood of loss of the liner prior to use.

12 Claims, 20 Drawing Figures

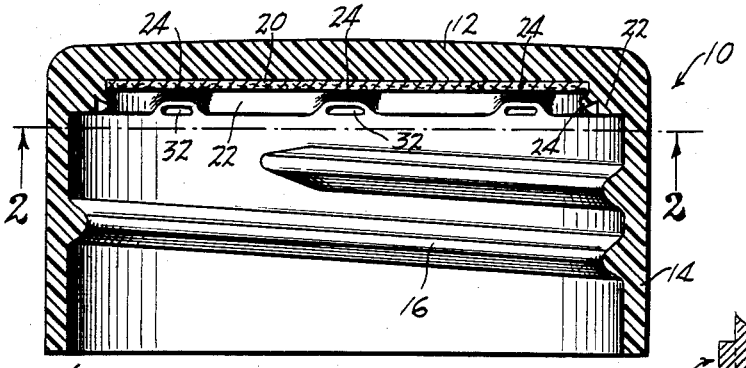
Fig. 1
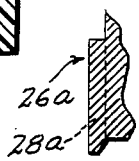
Fig. 7
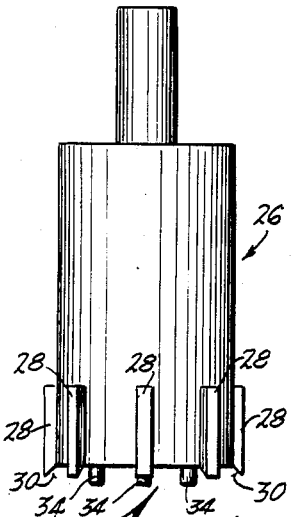
Fig. 5
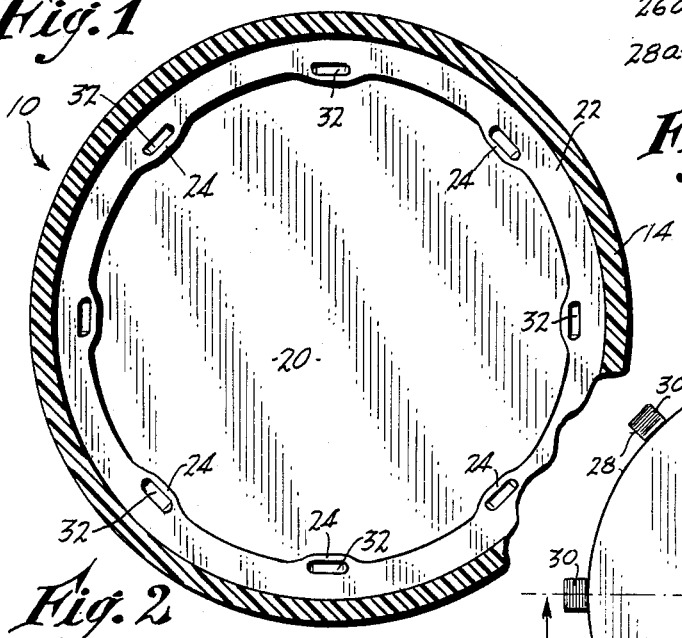
Fig. 2
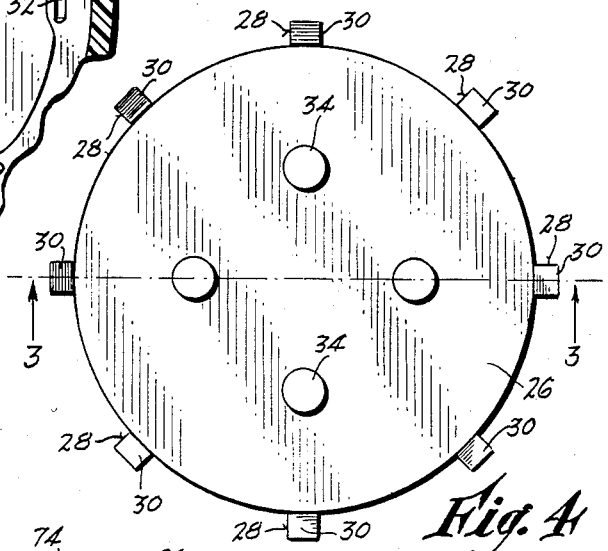
Fig. 4
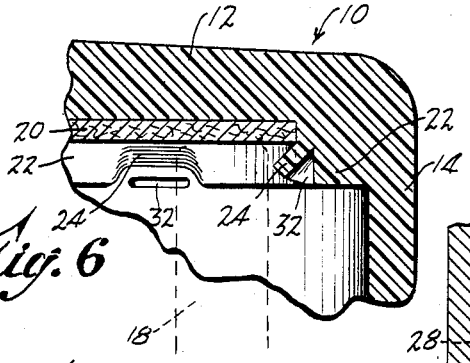
Fig. 6
Fig. 8
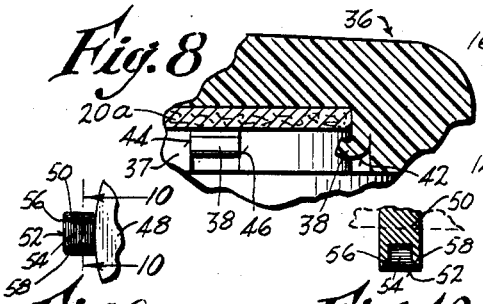
Fig. 9
Fig. 10
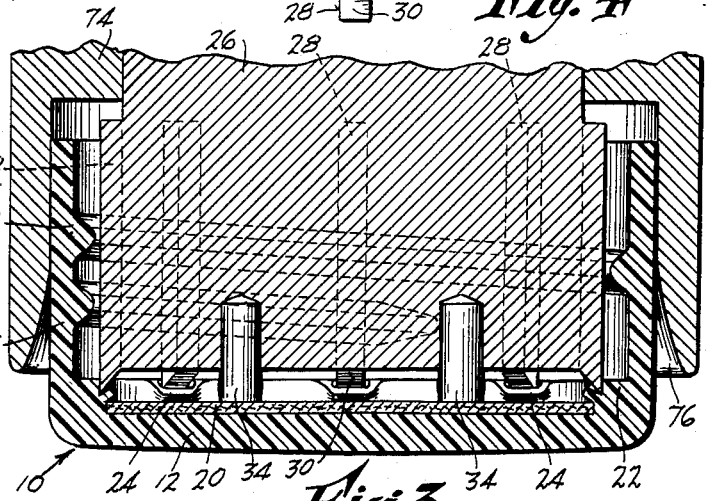
Fig. 3

CAP AND MEANS FOR RETAINING CAP LINER

BACKGROUND OF THE INVENTION

This invention relates generally to resilient sealing liners for closure caps, and more particularly to a cap construction and a method for inserting such liners therein without causing damage to either the cap or the liner.

A number of arrangements for retaining liners in closures have been proposed and produced. The most common approach has been to employ a series of circumferentially spaced, inwardly protruding lugs adjacent the top wall of a closure cap, and to press the liner into position such that it by-passes the lugs. In so doing, in almost every case there occurred a significant deformation of the liner, since the diameter of the latter had to be somewhat larger than the distance between opposite lugs. The deformation occurred as a result of both bending of the liner along a diameter, and compression of the edge portion thereof, as it was forced by the lugs. Although this method of retaining such liners has found wide acceptance in the industry, there existed a tendency for the liners to separate during subsequent handling of the cap. An example of such a construction is illustrated in U.S. Pat. No. 4,381,840; the problem associated with the liners falling out is addressed in column 3 of the patent, lines 34–41.

Other examples of retainer lugs are shown in U.S. Pat. Nos. 3,612,325; 2,904,837; 1,937,492. U.S. Pat. No. 2,039,757 describes an arcuate bead that extends for a major part of the circumference of the cap. The patent mentions an angle of 250° as having been found to provide good results.

Other methods for securing a liner have involved gluing the part in position in the cap. This had the obvious disadvantage that the integrity of the bond was uncertain. Moreover, it was always difficult to determine exactly how much glue or adhesive would be required in order to provide adequate adhesion, yet avoid the tendency for the glue to ooze out past the liner. Glue is thus considered not a good solution to the problem.

A still further alternative was to rely upon the threads of the cap in order to retain the liner. Under such circumstances, the diameter of the liner was made sufficiently large that it would not easily by-pass such threads. In order to insert the part, it was forcibly pressed past the threads, and usually occupied a recessed area lying between the upper end of the threads and the cap top wall. This arrangement usually resulted in worse damage to the liner, since the threads of the cap, being constituted of relatively stiff plastic, did not yield to any significant extent; instead they caused compression of the edge or periphery of the liner. Even after the liner was seated, it generally did not possess the flat or smooth characteristics of a new, undistorted liner piece. The tendency for there to occur inadvertent loosening of a liner retained in this manner is still prevalent, and the problem continues to cause difficulty for both container manufacturers, their customers who distribute the products, and ultimately the consumer.

SUMMARY

The above drawbacks and disadvantages of prior closure caps of the type employing captive liners is largely obviated by the present invention which has for one object the provision of a novel and improved closure cap construction employing a captive liner, which is both simple in its structure and reliable in use, even over extended periods.

A related object of the invention is to provide an improved closure cap construction as above set forth, and method for its assembly, wherein the liner can be readily inserted into the cap with essentially no deformation of either the liner or cap occurring, thereby preserving the integrity of the seal provided when the cap is assembled to a container.

Still another object of the invention is to provide an improved closure cap construction and method as above characterized, wherein the assembly of the liner to the cap is greatly facilitated by minimizing the number of separate operations required.

Yet another object of the invention is to provide an improved closure cap construction and method of the kind indicated, wherein the need for glues, adhesives or the like is completely eliminated, thereby reducing possible hazards with product contamination resulting from such substances.

A still further object of the invention is to provide an improved closure cap construction and method as outlined above, wherein the likelihood of the liner becoming inadvertently dislodged, following insertion, is virtually eliminated. As a consequence, problems with lost or mispositioned liners are reduced, and the overall capping operation thereby simplified. Losses due to down-time on assembly lines, or due to requirements for additional quality control procedures are thus minimized.

The above objects are accomplished by a plastic closure for use with a container to close off the same, comprising a cupshaped molded plastic cap having a top wall and an annular side wall integral with the top wall, the cap having means for securing it to the dispensing orifice of the container. Carried by the cap is a sealing liner, disposed under the top wall. The cap has an inner ledge structure adjacent to the liner, and the ledge structure has at least one portion at its inner periphery that is forcibly displaced from the remainder of the ledge structure, such portion overlying a peripheral portion of the liner and forming a retention shoulder to retain the liner against inadvertent dislodgement from the cap. The ledge structure has a pocket or space behind the displaced portion, which is formed concurrently with the formation of the displaced portion. The arrangement is such that the liner can be fully seated in an inverted cap without having to first forcibly by-pass any type of retainer structure, such as lugs, threads, etc. Thereafter the displaced portion or retention shoulder is formed in the ledge structure of the cap in such a manner as to overlie the liner and hold it captive.

The method of the invention involves installing a sealing liner in position in a plastic closure cap, the cap having a top wall and an integral annular side wall, and having an inner ledge structure integral with both the top wall and the side wall of the cap, the method comprising the steps of inserting the liner in the cap with the latter in an inverted position, such that the liner arrives at the ledge structure, and thereafter displacing or shearing a portion of the ledge structure in at least one location so as to form an abutment or retention shoulder that overlies a peripheral portion of the liner in order to prevent the latter from inadvertently falling out when the cap is subsequently handled or turned right side up.

Since the liner is inserted into the cap without having to be forced past any type of retainer structure (lugs, threads, etc.) the liner arrives at its intended location in an essentially undisturbed and undeformed state. That is, it has not undergone bending, squeezing, compression or been subjected to any other similar damaging forces that might tend to dent the edge portions thereof. Also, by the elimination of adhesives or glues, problems with product contamination are eliminated. In addition, the integrity of the retention of the liner can be readily determined by a quick visual inspection. The above advantages were generally not enjoyed by the various arrangements of the prior art. To the best of the applicant's knowledge, the only previous arrangement that did not involved a physical distortion of the liner was in the case where glue was employed. The disadvantage of this approach has been noted above.

Other features and advantages will hereinafter appear.

In the drawings, illustrating several embodiments of the invention, and steps involved with the method of the invention:

FIG. 1 is an axial section of the improved closure cap and sealing liner of the invention, particularly illustrating the arrangement by which the retention of the liner in the cap is accomplished.

FIG. 2 is a transverse or horizontal section taken on the line 2—2 of FIG. 1.

FIG. 3 is an axial section of the closure cap of FIG. 1, and a fragmentary axial section of a displacement-type punch displacing portions of a ledge structure of the cap, such portions overlying the periphery of the cap inner liner and retaining the latter against inadvertent dislodgement.

FIG. 4 is a bottom plan view of the punch of FIG. 3 as employed in the method of inserting and retaining the inner liner in position in the cap.

FIG. 5 is a side elevational view of the punch of FIGS. 3 and 4.

FIG. 6 is a fragmentary axial section of the cap enlarged, similar to a portion of FIG. 1 and showing the cap and liner, with several displaced portions of the ledge structure of the cap overlying the liner to thereby retain the latter.

FIG. 7 is a fragmentary section of a modified punch, similar to that of FIG. 5 except having working edges or faces which are not as sharp as those of the punch of FIG. 5.

FIG. 8 is a fragmentary section like FIG. 6 but of another embodiment of the invention, wherein displaced portions of the ledge structure of the cap take the form of lugs or retention shoulders which have been sheared from the structure, and which can assume a curvilinear configuration, the lugs overlying the periphery of the ledge structure.

FIG. 9 is a fragmentary bottom plan view of a further modified punch of a type which would produce well defined lugs of the kind illustrated in FIG. 8.

FIG. 10 is a section taken on the line 10—10 of FIG. 9.

Figure 17:
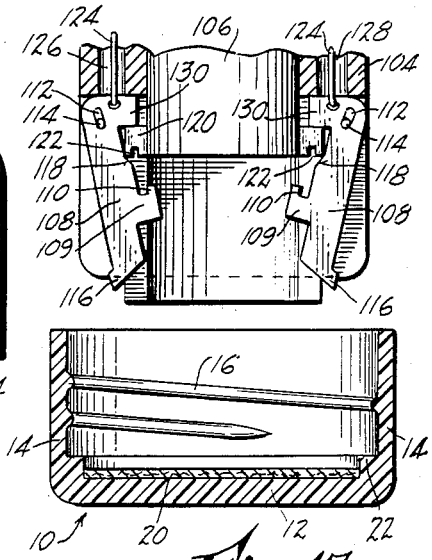
FIG. 17 is a view, partly in axial section and partly in elevation, showing a closure cap to be processed and a modified punch construction of a type having retractable taper teeth, for use in the method of inserting and retaining the cap liner in the cap as embodied in the present invention. The taper teeth are shown occupying their fully retracted positions.
Figure 15:
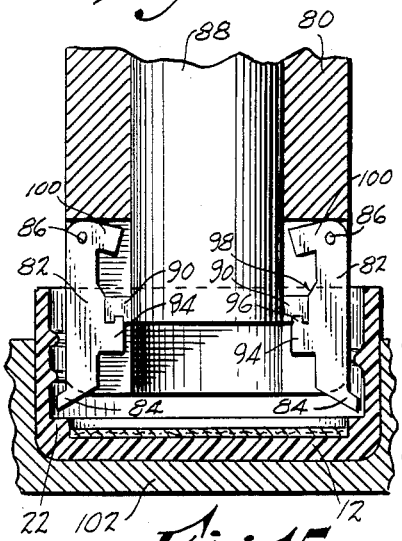
FIG. 15 is a view like that of FIGS. 13 and 14 except showing the taper teeth having been advanced in radially outward directions and just prior to their engagement with the ledge structure of the cap.
Figure 18:
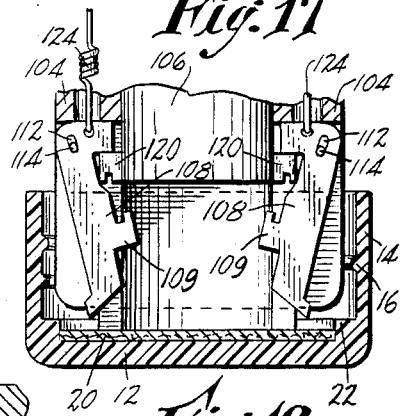
FIG. 18 is a view like that of FIG. 17 except illustrating the clamping of the inner liner of the cap, and the positions of the punch and its taper teeth just prior to further advancement of the latter and after the teeth have by-passed the location of the cap threads.
Figure 19:
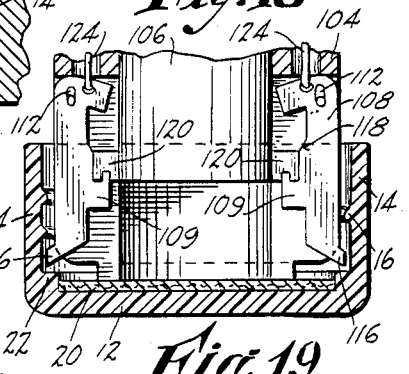
Figure 16:
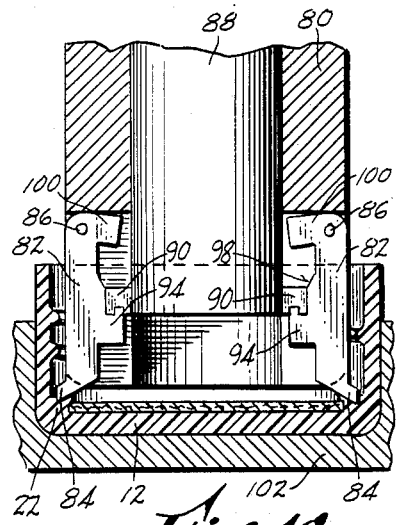
FIG. 16 is a view like that of FIGS. 13–15, showing the taper teeth fully advanced radially and forcibly shifted in a downward direction so as to engage and displace portions of the ledge structure of the cap.
Figure 14:
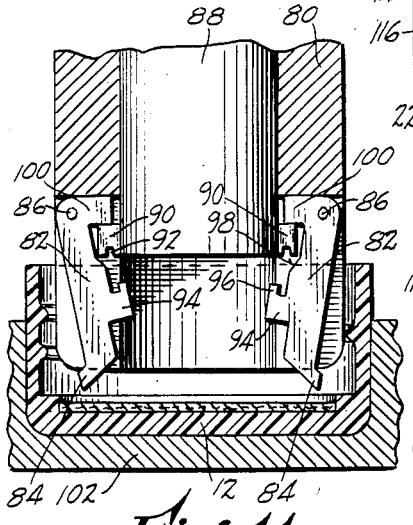
FIG. 14 is a view like that of FIG. 13 except illustrating the positions of the punch and its taper teeth just prior to the advancement of the latter, and after the teeth have by-passed the location of the cap threads.
Figure 20:
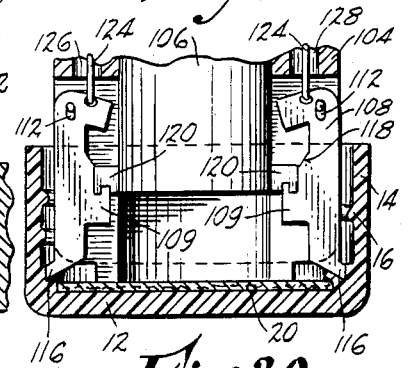

FIG. 19 is a view like that of FIGS. 17 and 18, except showing the taper teeth having been swung in radially outward directions, and just prior to their engagement with the ledge structure of the cap, and FIG. 20 is a view like that of FIGS. 17–19, showing the taper teeth fully swung radially and further forcibly shifted in a downward direction by a driving rod portion of the punch so as to engage and deform the ledge structure of the cap.

Referring first to FIGS. 1, 2 and 6 there is illustrated a closure cap construction generally designated by the numeral 10 and having a top wall 12 and integral annular side wall 14. The inner surface of the side wall is provided with retaining means in the form of a screw thread 16 in order to enable the cap to be screwed onto a bottle, jar or other container 18 indicated in dotted outline in FIG. 6, all in the usual manner. In FIG. 6, the dispensing orifice of the container is the area at the left of the dotted outline, as can be readily understood. The cap 10 carries a resilient sealing inner liner 20, in order to provide resistance against leakage when the cap is assembled to the container 18.

In accordance with the present invention there is provided a novel and improved retainer construction on the cap 10, for holding captive the liner 20 following insertion of the latter. In accomplishing such retention the underside of the cap is provided with a ledge structure 22 which may take the form of a continuous annulus providing a nest for the liner, and circumferentially spaced portions 24 thereof are offset in a radially inward direction, as shown in FIG. 2 by forcibly shifting drifting and distorting the material out of which the ledge structure 22 is constituted. The shifting or displacing of material is accomplished by a special punch 26, shown in FIGS. 3–5, having a series of circumferentially spaced taper teeth 28 that are adapted to simultaneously penetrate into the surface of the ledge structure 22 in the manner illustrated in FIG. 3. The punch 26 is initially applied to the cap 10 with the latter inverted and subsequent to the liner 20 having been inserted into the space just under the top wall 12. The punch is shown as having eight teeth 28, but a lesser number could be employed, if desired, as dictated by the requirements of a particular application. The angular displacing shear faces of the teeth 28 are designated 30.

The punch 26 thus forms a plurality of pockets 32 in the ledge structure 22, and the pockets 32 are disposed between the displaced portions 24 and the remaining or outer areas of the ledge structure 22. In FIG. 2, the displaced portions are in the form of rounded shoulders or nibs having curved surfaces which gradually merge into the surfaces of the ledge structure 22 on either side of each nib.

In FIG. 4 there are illustrated four resilient positioning pads or pins 34 which can be of rubber, each being received in a corresponding recess of the punch 26 and protruding from the bottom thereof as shown. These pins function to maintain the liner 20 captive and positioned against the inner surface of the cap top wall 12, as in FIG. 3. This insures that as the displacing of the ledge structure 22 is occurring and the displaced portions 24 are forced in a radially inward direction, they will properly overlie the periphery of the liner 20 and thereafter prevent its inadvertent dislodgement after removal of the punch 26.

The above construction is seen to have the following advantages, which are believed to be significant, and which are generally not enjoyed by many of the devices of the prior art. Since the liner 20 is inserted in the cap 10 prior to the formation of any of the displaced portions or shoulders 24 of the ledge structure 22, the liner 20 does not undergo any deformation. That is, the liner 20 is normally circular, and its diameter is just slightly less than that of the inner diameter of the ledge structure 22. In addition, the diameter of the liner 20 is less than the inner diameter of the threads 16 on the cap side wall 14. Thus, no interference whatsoever is encountered in the initial insertion and positioning of the liner 20 in the cap 10. After the liner 20 is in place, the retainer structures in the form of the displaced portions 24 are imparted to the cap by means of the punch 26, in the manner set forth above. Since the liner 20 is seated and held in place by the positioning pins 34 at this time, no damage or deformation of the liner occurs. It is thus installed and thereafter retained in an essentially unmarked or undistorted condition.

With prior liners, in almost all cases the liner was inserted by forcing it past the retention lugs that ultimately held it in place, or alternately, forced past the threads of the cap. Such procedures stressed the liner, because it had to be bent or crinkled. In many cases, damage to the liner occurred. If the deformation that resulted from installation was severe, the liner was susceptible to becoming dislodged after the cap was later handled or installed. The distortion also sometimes adversely affected the sealing characteristics of the cap and its container.

The applicant's improved construction also eliminates the use of glues or adhesives, which in the past often led to problems with possible product contamination, or poor retention of the liner.

While the construction of FIGS. 1–3 and 6 shows a total of eight inwardly displaced portions 24 of the ledge structure 22, other configurations and/or multiples could provide results which are comparable to that shown, as can be readily understood.

FIG. 7 illustrates, in fragmentary section, a somewhat modified punch **26*a* incorporating a displacing or taper tooth 28*a* having a flattened end face as opposed to the relatively sharp edges of the punch shown in FIG. 5. The flattened nature of the end face would impart a somewhat different characteristic to the displaced portions 24 and pockets 32**, and might be better suited for use with certain types of plastic substances.

Another embodiment of the invention is shown in FIG. 8. The cap 36 thereof is illustrated in fragmentary section, as is the liner **20*a*. By the invention, the cap 36 is provided with a ledge structure 37 in the form of an annulus. There is struck from the annulus 37 a plurality of radially inwardly extending lugs 38 that overlie the periphery of the liner 20*a*, as shown. The lugs 38 have a curvilinear cross-section, with a concave surface facing the liner, and an opposite convex surface 42 facing the open end of the cap 36. The lugs 38 have relatively flat opposite sides 44, 46 that are generally parallel to the axis of the cap. In order to form this type of lug, a modified punch 48 as shown in FIGS. 9 and 10 is employed. The punch 48 has cutters 50 each having a bottom, outer cutting edge 52 which forms a pocket 54 inside of the respective tooth, and side cutting edges 56, 58 which generate the side walls 46, 44 respectively of the lugs 38; the side cutting edges 56, 58 are particularly shown in FIGS. 9 and 10. With such a punch configuration, the lugs 38 can be made to curl as shown, and thus overlie the periphery of the liner 20*a***.

Figure 11:
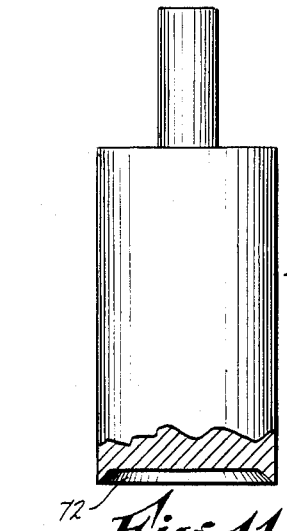
FIG. 11 is a view, partly in elevation and partly in axial section, of a still further modified punch characterized by an essentially continuous circular cutting and displacing edge.
Figure 12:
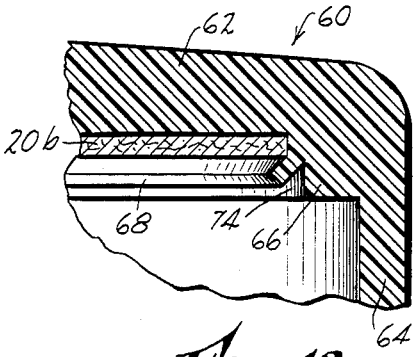
FIG. 12 is a fragmentary axial section of a cap showing a liner retained by the essentially circular ring formed by the punch of FIG. 11 in shearing or displacing a part of the ledge structure of the cap along a full 360 degrees.

Still another embodiment of the invention is shown in FIG. 12, wherein a cap 60 is provided, having a top wall 62, an integral annular side wall 64, and an integral ledge structure 66 at the juncture thereof. By the invention, the ledge structure 66 is displaced radially inwardly along substantially a complete 360° circle, forming a ring 68 that overlies the entire periphery of the liner **20*b*. In accomplishing the formation of the ring 68, a modified punch 70 such as that shown in FIG. 11 would be employed, having an essentially circular cutting edge 72. The punch 70 would be applied to the inside of the cap 60 of FIG. 12 after the liner 20*b* had been inserted. Following removal of the punch 70, the ring 68 would remain in the position shown, thereby retaining the liner 20*b*** against inadvertent dislodgement. The material out of which the cap is constituted would have to be suitable for such an operation. It is believed that polyethylene would provide satisfactory results. Other substances such as polypropylene or polystyrene may be susceptible to such formation, although there might be a tendency for cracking to occur if the displacement was too great.

As is similar to previous embodiments of the invention, the formation of the ring 68 creates a pocket 74 separating the ring 68 from the remainder of the ledge structure 66.

Referring again to FIGS. 1–6, the present invention also embraces a novel method involving the installation and retention of the liner 20 in a plastic closure cap 10. The cap 10 as already described has a top wall 12 and an integral side wall 14, and an inner ledge structure 22 integral with both the top wall and side wall. The method of the invention comprises the steps of inserting the liner 20 into the cap 10, preferably with the latter in an inverted position as shown in FIG. 3, such that the liner 20 arrives and locates at the ledge structure 22, and thereafter displacing a portion 24 of the ledge structure in at least one location so as to form a shoulder or abutment that overlies a peripheral portion of the liner in order to prevent the latter from inadvertently falling out when the cap is subsequently handled or turned right side up. The displacing step may take the form of shifting portions 24 of the ledge in a radially inward direction, as illustrated in FIGS. 1–3 and 6, or alternately in shearing a lug 38 from the ledge structure, as in FIG. 8. Also, the entire ledge structure 66 (FIG. 12) can be sheared along its inner periphery so as to form the ring 68.

Referring now to FIG. 3 and in accordance with the present invention means are provided for maintaining centralized the displacing or taper teeth 28 with respect to the axis of the cap 10 while the punch 26 is being introduced therein, so as to prevent inadvertent engagement of the teeth 28 with the inner surface of the cap annular side wall 14. In accomplishing such centralization, the punch 26 rigidly carries a depending annular skirt 74 having a tapered annular lead-in edge portion 76, the diameter of the inner surface of which exceeds that of the outer diameter of the cap 10. The skirt 74 is adapted to surround the cap side wall 14 during the time that the punch 26 is being advanced toward the cap top wall 12. The inside diameter of the skirt 74 at the portion which is disposed remote from its edge exceeds the outside diameter of the cap annular side wall 14 by an amount which permits a sliding, non-binding fit to occur between the two parts. With such an arrangement, all parts of the side wall 14 are precisely positioned with respect to the axis of the punch 26, as well as with respect to the displacing teeth 28 thereof. As can be readily appreciated from an inspection of the figure, there are relatively small clearance spaces between the teeth 28 of the punch and the threads 16; it is considered important to insure that the teeth 28 do not come into contact with any parts of the threads. Otherwise the teeth might possibly slice into the threads and cause tearing or other undesirable deformation thereof. By the present invention, the dimensions of the punch 26 and skirt 74, both being machined parts, are maintained to close tolerances and are held essentially perfectly coaxial with one another. The possibility of inadvertent contact between the teeth 28 and the cap threads 16 is thus greatly minimized.

Figure 13:
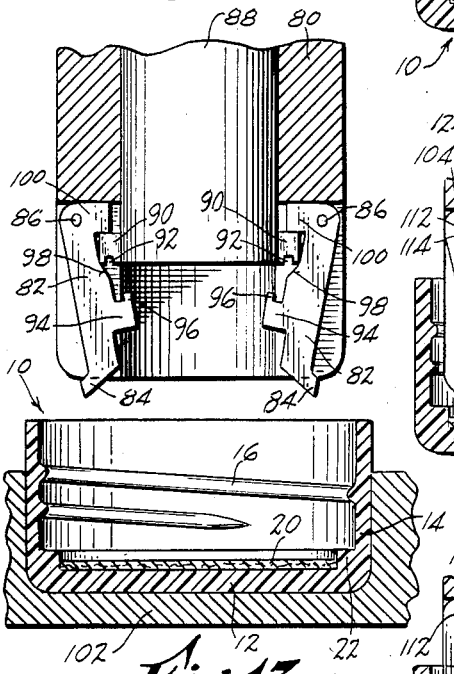
FIG. 13 is a view, partly in axial section and partly in elevation, of a cap and nest therefor, and a punch construction having retractable bits with taper or displacing teeth, for use in the method of inserting and retaining the cap liner in the cap as embodied in the present invention. The taper teeth are shown occupying fully retracted positions.

An alternate arrangement for providing protection for the threads 16 of the cap 10 is shown in FIGS. 13–16, illustrating a sleeve 80 carrying two diametrically opposed bits 82 having taper teeth 84. By the present invention the teeth 84 are retractable, and can selectively be positioned to lie substantially completely within the confines of the outer cylindrical surface of the sleeve 80. The sleeve has slots which receive the bits 82, and the latter are carried on pivot pins 86 in the slots. A central bore of the sleeve 80 slidably carries a driver rod 88 having diametrically opposed drive lugs 90 that have slots 92. The drive lugs 90 are adapted to engage corresponding driven lugs lugs 94 on the bits 82, the lugs 94 having ribs 96. FIG. 13 shows the driver rod 88 retracted, with the bits 82 disposed in their fully retracted positions. It is noted that under this condition the teeth 84 of the bits 82 lie substantially completely within the confines of the outer cylindrical surface of the sleeve 80 as shown.

On the inner portions of the bits 82, cam surfaces 98 are disposed above the lugs 94 and are intended to be engaged by the lugs 90 of the driver rod 88 when the latter is advanced, as will be explained below. The bits 82 are retained in their fully retracted positions by engagement of bit-retraction shoulders 100 with the drive lugs 90 on the driver rod 88. This condition is particularly illustrated in FIG. 13.

In the method of the invention involving the installation of the liners in the caps, the latter are placed in cup-shaped recesses in a suitable die or base 102. Initially the sleeve 80 and driver rod 88 are advanced together toward the cap, as in FIG. 14, with the bits 82 retracted fully. When the teeth 84 of the bits 82 pass the cap threads 16, the sleeve 80 is halted while the driver rod 88 continues to move toward the cap. The engagement of the drive lugs 90 on the driver rod 88 and the cam surfaces 98 of the bits 82 causes the latter to pivot about pins 86 in radially outward directions. Continued movement of the driver rod will result in a complete advancement of the bits, as in FIG. 15. At this point the teeth 84 are fully extended radially, and in position to engage the ledge structure 22 of the cap 10. Following engagement of the lugs 94 and 90, the sleeve 80 and driver rod 88 now move together, as a unit, to displace the diametrically opposed portions of the ledge structure 22. As this is occurring, it is to be noted that the area adjacent the threads of the cap has been completely by-passed by the teeth 84 which are extended radially for only a short interval, from a time just prior to engagement with the ledge structure 22 until the required displacement has been effected. Following the formation of the retainer lugs or shoulders 24 in the ledge structure 22 of the cap, the driver rod 88 is first retracted, causing the bits 82 to pivot radially inwardly, whereby the threads of the cap are again completely protected as the sleeve 80 and driver rod 88 are withdrawn.

An alternate arrangement for securing the liner 20 of the cap 10 is illustrated in FIGS. 17–20. As in the previous device the punch employs a sleeve 104 and driver rod 106. By the invention, the sleeve is slotted, and carries displacing or taper bits 108 having driven lugs 109, ribs 110 and slots 112 which receive pivot pins 114 to enable the bits to both pivot and shift translationally in the sleeve 104. The taper teeth are indicated 116. The bits 108 have camming surfaces 118 which are adapted to be engaged by lugs 120 on the driver rod 106. The drive lugs 120 have grooves 122, as shown.

The upper portion of each bit 108 has a tensile spring retractor 124, each of which normally biases its respective bit 108 to a raised and retracted position as in FIGS. 17 and 18. The springs 124 are received in longitudinal passages 126 and 128 of the sleeve 104.

By the present invention, as the sleeve 104 and driver rod 106 are being advanced toward the cap 10, the bits 108 and their respective teeth 116 are retracted, enabling the teeth to bypass the cap threads 16. The sleeve 104 and driver rod 106 move as a unit until a point is reached where the teeth 116 arrive at the location of the ledge structure 22 of the cap. At this point, the sleeve 104 is halted and clamps the liner 20 securely in correct position in the cap 10; now the driver rod 106 continues to advance, and the lugs 120 ride on the respective cam surfaces 118 and eventually engage the driven lugs 109 of the bits. The driver rod 106 is further advanced a slight amount, carrying with it the bits 108 and their corresponding teeth 116, which in turn displace the opposed areas of the ledge structure 22, as in the previous case. Following this operation the driver rod 106 is retracted slightly, enabling the retraction springs 124 to pull the bits 108 upwardly and allow them to pivot toward their retracted positions wherein shoulders 130 are clamped by the lugs 120. When the bits 108 are fully retracted, the sleeve 104 and driver rod 106 are then withdrawn as a unit, from the cap 10. With the arrangement just described, it can be seen that the cap threads 16 are completely protected from the teeth 116 as the latter pass such threads. Accordingly there is virtually no possibility of damage to such threads, as from tearing or gouging.

From the above it can be seen that I have provided novel and improved cap constructions and captive liners therefor which are especially simple, and which solve many of the problems inherent in the prior art devices. Forcible installation of the liner is completely eliminated, and accordingly there are no problems resulting from damage or distortion of the liner. The use of adhesives has been completely eliminated, thereby simplifying the overall assembly procedure.

The disclosed devices and methods are thus seen to constitute a distinct advance and improvement in the technology of closure cap constructions.

Each and every one of the appended claims defines an aspect of the invention which is separate and distinct from all others, and accordingly each claim is intended to be treated in this manner when examined in the light of the prior art devices in any determination of novelty or validity.

Variations and modifications are possible without departing from the spirit of the invention.

What is claimed is:

1. A plastic closure for use with a container to close the same, comprising in combination:

(a) a cup-shaped molded plastic cap having a top wall and an annular side wall integral with the top wall and provided with means for securing the cap to the dispensing orifice of the container, (b) a sealing liner disposed in the cap under the top wall thereof, (c) said cap having an inner ledge ledge structure surrounding the sealing liner and providing a nest therefor, (d) said inner ledge structure having a plurality of pockets disposed in spaced relation about the sealing liner and opening downwardly with respect to the top wall of the cap, (e) said inner ledge structure having forcibly inwardly displaced drifted and distorted portions located radially inward of said pockets and overlying peripheral portions of the sealing liner to retain the latter in place against inadvertent dislodgement from the cap, said ledge structure having a pocket behind each displaced portion, said pockets being formed concurrently with the formation of the displaced portions.

2. The invention as set forth in claim 1, wherein:

(a) said inner ledge structure is annular, and is characterized by an inside diameter which is greater than that of the liner and less than the inner diameter of the cap side wall.

3. The invention as set forth in claim 1, wherein:

(a) said inner ledge structure and the cap top wall form a cup-like seat in which the sealing liner is nested.

4. The invention as set forth in claim 1, wherein:

(a) said pockets are located between the inwardly displaced portions of the ledge structure and remaining portions of said ledge structure.

5. The invention as set forth in claim 1, wherein:

(a) said ledge structure is annular, (b) said inwardly displaced portions comprising multiple shoulders formed by deforming circumferentially spaced area of the ledge structure.

6. The invention as set forth in claim 1, wherein:

(a) said ledge structure is annular, (b) said inwardly displaced portions comprising multiple shoulders struck from circumferentially spaced areas of the ledge structure.

7. The invention as set forth in claim 1, wherein:

(a) the ledge structure is annular, and (b) the inwardly displaced portions are spaced circumferentially about the ledge structure.

8. The invention as set forth in claim 1, wherein:

(a) said pockets each extend into the ledge structure and to a point below the upper surface thereof.

9. The invention as set forth in claim 1, wherein:

(a) substantially all parts of the ledge structure that lie circumferentially between the pockets are of substantially uniform cross sectional area.

10. The invention as set forth in claim 1, wherein:

(a) said ledge structure has an outwardly facing surface of generally planar configuration, perpendicular to the axis of the cap.

11. A plastic closure for use with a container to close the same, comprising in combination:

(a) a cup-shaped molded plastic cap having a top wall and an annular side wall integral with the top wall and provided with means for securing the cap to the dispensing orifice of the container, (b) a sealing liner disposed in the cap under the top wall thereof, (c) said cap having an inner ledge structure adjacent to the sealing liner, (d) said inner ledge structure having at least two circumferentially spaced-apart portions at its inner periphery that are drifted and distorted by virtue of their having been forcibly displaced from the remainder of the ledge structure, said portions being disposed radially inward of the said remainder and overlying peripheral portions of the sealing liner to thereby retain the same.

12. A plastic closure for use with a container to close the same, comprising in combination:

(a) a cup-shaped molded plastic cap having a top wall and an annular side wall integral with the top wall and provided with means for securing the cap to the dispensing orifice of the container, (b) a sealing liner disposed in the cap under the top wall thereof, (c) said cap having an inner ledge structure surrounding the sealing liner and providing a nest therefor, (d) said inner ledge structure having a plurality of pockets disposed in spaced relation about the sealing liner and opening downwardly with respect to the top wall of the cap, (e) said inner ledge structure having forcibly inwardly displaced portions located radially inward of said pockets and overlying peripheral portions of the sealing liner to retain the latter in place against inadvertent dislodgement from the cap, said ledge structure having a pocket behind each displaced portion, said pockets being formed concurrently with the formation of the displaced portions, (f) said ledge structure being annular, (g) said inwardly displaced portions comprising multiple shoulders formed by deforming circumferentially spaced areas of the ledge structure, (h) said shoulders each being characterized by a smooth, curved inner surface that merges gradually into the ledge structure on opposite sides of each of the shoulders.

* * * * *